US009944451B2

(12) United States Patent
Ruhnau et al.

(10) Patent No.: US 9,944,451 B2
(45) Date of Patent: Apr. 17, 2018

(54) ATTACHMENT FOR A BOTTLE

(71) Applicants: Harald Ruhnau, Hamm (DE); Axel Finkler, Hamm (DE)

(72) Inventors: Harald Ruhnau, Hamm (DE); Axel Finkler, Hamm (DE)

( * ) Notice: Subject to any disclaimer, the term of this patent is extended or adjusted under 35 U.S.C. 154(b) by 0 days.

(21) Appl. No.: 15/111,547

(22) PCT Filed: Jan. 27, 2015

(86) PCT No.: PCT/EP2015/051585
§ 371 (c)(1),
(2) Date: Jul. 14, 2016

(87) PCT Pub. No.: WO2015/113963
PCT Pub. Date: Aug. 6, 2015

(65) Prior Publication Data

US 2016/0325912 A1 Nov. 10, 2016

(30) Foreign Application Priority Data

Jan. 29, 2014 (DE) ..... 10 2014 101 073

(51) Int. Cl.
*B65D 81/32* (2006.01)
*B65D 51/28* (2006.01)
*B65D 23/12* (2006.01)

(52) U.S. Cl.
CPC ..... *B65D 81/3205* (2013.01); *B65D 23/12* (2013.01); *B65D 51/28* (2013.01); *B65D 81/3211* (2013.01)

(58) Field of Classification Search
CPC ..... B65D 81/3205; B65D 81/32; B65D 81/3211; B65D 51/28; B65D 51/24; B65D 51/16; B65D 23/12; B65D 23/00
(Continued)

(56) References Cited

U.S. PATENT DOCUMENTS 2,171,302 A * 8/1939 Conner ..... B65D 47/061 220/304
2,372,281 A * 3/1945 Jordan ..... A61J 9/04 215/11.1

(Continued)

FOREIGN PATENT DOCUMENTS

DE 3220693 12/1983
DE 202004016982 10/2005

(Continued)

OTHER PUBLICATIONS

International preliminary report on patentability for application No. PCT/EP2015/051585 dated Jan. 27, 2015.

(Continued)

*Primary Examiner* — Robert J Hicks
(74) *Attorney, Agent, or Firm* — Bachman & LaPointe, PC

(57) ABSTRACT

An attachment (1) for a bottle which holds a first liquid, wherein the bottle has a bottle opening and is surrounded by a wall, and wherein the attachment is delimited from the surrounding area by an outer wall (18) and has a bearing surface (2) for bearing sealingly against the bottle, a reservoir (4) which is designed to hold a second liquid, a channel (6) which connects the bottle opening to an outlet of the attachment, and a passage (20) which connects the reservoir to the channel. In order to ensure secure fastening of the attachment (1) to the bottle, the attachment is designed to be attached concentrically to the bottle outside of the bottle opening and the attachment has a bearing surface which is provided with a seal (12).

4 Claims, 4 Drawing Sheets

(58) Field of Classification Search
USPC ..... 215/386, 387, 227, 228; 220/368, 367.1, 220/373, 212, 713, 711, 703; 206/532, 206/538; 222/568, 567, 566
See application file for complete search history.

(56) References Cited

U.S. PATENT DOCUMENTS

| | | | | | |
|---|---|---|---|---|---|
| 2,661,870 | A | | 12/1953 | Huenergardt | |
| 2,947,453 | A | * | 8/1960 | Parish, Jr. ..... | B65D 47/061 222/539 |
| 3,059,816 | A | * | 10/1962 | Goldstein ..... | B65D 47/0842 215/235 |
| 3,206,074 | A | | 9/1965 | Hoffmann | |
| 4,730,381 | A | | 3/1988 | Dirksing | |
| 2009/0184083 | A1 | * | 7/2009 | Cho ..... | B65D 47/06 215/227 |
| 2010/0001018 | A1 | | 1/2010 | Puma | |

FOREIGN PATENT DOCUMENTS

| | | |
|---|---|---|
| DE | 202008008018 | 9/2008 |
| DE | 102012110833 | 12/2013 |
| GB | 2259241 | 3/1993 |
| WO | 92/02434 | 2/1992 |
| WO | 2006/047795 | 5/2006 |
| WO | 2011/003048 | 1/2011 |

OTHER PUBLICATIONS

European Office action dated Jul. 14, 2017 for European Patent Application No. 15705213.5.

* cited by examiner

ATTACHMENT FOR A BOTTLE

BACKGROUND OF THE INVENTION

The invention relates to an attachment for a bottle.

For the mixing of two liquids, for example mixed drinks, arrangements are known from WO 92/02434 A1, in which two containers for liquids are arranged in each other so that the two liquids can mix when poured out. For bottles, such an arrangement is technically hardly economically realizable. WO 2011/003048 A1 shows attachments for bottles which are either screwed on the bottles or are mounted on the bottles by means of a sealing lying outside. An arrangement for the mixing of a liquid with solid flavors is disclosed in DE 20 2004 016 982 U1. An attachment is placed on the bottle. A solids reservoir is arranged in the bottle neck during placement of the attachment. The liquid exiting the bottle flows through the second reservoir in order to receive the flavors contained in it. A technical solution for mixing a liquid that is contained in a bottle by means of an attachment with a second liquid is not known. However, since mixed drinks from two different liquids are very popular, there is demand for such a solution.

DE 20 2008 008 018 U1 and DE 10 2012 110 833 show attachments for cans, in which separate holding elements immobilize the attachment on the can and cause a seal to engage with the flanged rim or respectively cover of the can.

SUMMARY OF THE INVENTION

The object of the invention is to suggest an attachment for a bottle, which enables the mixing of the liquid contained in the bottle with a second liquid and which is at the same time constructed as simply as possible.

The invention relates to an attachment with the characteristics disclosed herein.

The attachment according to the invention is developed for a bottle, which holds a first liquid, wherein the bottle has a bottle opening and is surrounded by a wall, and wherein the attachment is delimited from the surrounding area by an outer wall and has a bearing surface for bearing sealingly against the bottle, a reservoir which is designed to hold a second liquid, a channel which connects the bottle opening to an outlet of the attachment, and a passage which connects the reservoir to the channel. According to the invention, the attachment is designed to hold a second liquid and to be attached concentrically to the bottle outside of the bottle opening and the attachment has a bearing surface, which is provided with a seal.

The attachment is intended for a bottle. Bottles have a bottle wall, normally shaped like a cylindrical bottle wall extending upwards from the bottle bottom, which ends at a bottle opening. The bottle wall can be subdivided into two sections, which extend between the bottom and bottle opening. The bottle body extends from the bottom to the opening as the first section of the bottle wall, usually with the same diameter as the bottom. The bottle neck extends from the bottle opening as the second section of the bottle wall, wherein the bottle neck widens from the diameter of the bottle opening towards the diameter of the bottle body.

After the filling of the bottle up until use, the bottle opening is closed, e.g. with a plug or cork, a screw cap or with a crown cap. The bottle opening or the bottle neck frequently has a bulge, which provides stability against damage and with which e.g. crown caps engage as closure of the bottle opening. The first liquid contained in it can be removed from the bottle through the bottle opening, for example through pouring or drinking directly from the bottle.

The attachment according to the invention is preferably produced as a hollow body, which is penetrated by a channel and which can be mounted or placed in a sealing manner on the bottle opening or the bottle neck by means of a bearing surface formed in or on the channel. This attachment or hollow body is preferably cylindrical or rectangular. The attachment can be made of any materials that are suitable for food packaging. In particular, materials that can be processed with an injection molding process are preferred since the attachment according to the invention is preferably produced as an injection molding part. The attachment is placed or mounted for use on a bottle opening of an open bottle in accordance with the invention and the contents of the bottle are emptied through the bottle opening and the channel of the attachment connected to it through the outlet of the attachment.

It results from the above that the shape of the attachment can be mainly freely selected provided that the placement or mounting on a bottle is possible. In a simple design, the attachment is cylindrical with parallel-arranged top and bottom sides. But the attachment can also be designed in a rectangular manner, in particular in a polygonal, but also round or oval, manner.

The special advantage of the attachment is that the customer can freely decide which bottle contents, i.e. which first liquid is combined with which second liquid: for example, whether mineral water is mixed with raspberry syrup or whether a Berliner Weisse is created by placement on a beer bottle or whether an Alsterwasser is produced by combining lemonade with Pils or an alternative mixed drink by mixing with Weissbier.

The bearing surface of the attachment according to the invention is shaped in any manner. It is preferably designed as a narrow, circumferential surface. The bearing surface is also arranged according to the invention in the channel of the attachment. According to the invention, the bearing surface is made of a sealing material, which nestles sealingly against the bottle neck or respectively bottle opening when deformed. The sealing material is preferably elastic and compensates for the unevennesses on the bottle opening or the bottle neck without losing the sealing effect of the bearing surface. Elastic materials are preferably used as sealing material. This includes in particular rubber, latex as well as elastic plastics. In the case of an attachment produced in an injection molding process, the sealing material can be processed in a work process with the material of the attachment or the sealing material can be applied to the attachment or respectively to or in its channel later. Prefabricated seals, e.g. made of elastic plastic, can also be adhered to the or in the channel as long as the adhesive is suitable for use in food packaging.

It is generally sufficient if the bearing surface is designed as a narrow edge or narrow strip. However, the bearing surface is advantageously designed as a wide section on or in the channel so that a secure seal is guaranteed between the attachment and bottle and the mechanical stability of the attachment is also simultaneously optimized on the bottle.

According to an embodiment of the invention, the bearing surface is designed as a bearing bulge in the channel. This bearing bulge can engage around or behind the bulge on the bottle neck or respectively the bottle opening so that the mechanical stability of the connection and the seal are further improved. According to a preferred embodiment, the bearing surface is designed to be connected with the container wall through clamping or locking, in particular when the bearing surface is designed as a bearing bulge.

The special advantage of this embodiment of the attachment according to the invention is that no screwing or other measures for immobilizing the attachment on a bottle are required. The simple placement or mounting is sufficient.

The attachment has a reservoir, which is intended to hold a second liquid. The reservoir is surrounded by the material of the attachment and is thus delimited from the surrounding environment. The reservoir can be shaped in any manner. The reservoir can have any volume; however, the volume of the reservoir is preferably less than the volume of the bottle, on which the attachment is placed. The ratio of the volume of the reservoir of the attachment to the volume of the bottle is preferably 1:5 to 1:100, advantageously 1:10 to 1:50.

The attachment has a channel, which establishes a connection between the bottle opening and an outlet of the attachment. The channel thus establishes a line or respectively a flow connection through the attachment. The channel generally receives the bearing surface or the bearing surface is arranged on an inlet opening of the channel. In a typical embodiment of the attachment, which is intended for connection with a round bottle neck or a round bottle opening, the attachment is designed as a cylindrical body, which is penetrated by a channel. The bearing surface is designed in the channel so that the attachment can be mounted on the open bottle. An approximately annular body is created, in which the reservoir is arranged for a second liquid between the channel and an outer wall of the attachment.

The channel has an outlet on the end lying opposite the inlet opening. The outlet is preferably shaped ergonomically, for example as a spout or drink opening. The channel can have any cross-section, e.g. in order to better meet the requirements of the design of the attachment. The inlet opening and the outlet can have different cross-sections, also in order to ensure the quickest possible emptying of the bottle or in order to ensure the most compact structural shape of the attachment. The channel connects the inlet opening and the outlet and for this purpose can have a changing cross-section, a narrowing or expanding cross-section, e.g. in order to optimize the flow conditions when removing the first liquid or the first and the second liquid.

According to a particularly advantageous embodiment of the attachment according to the invention, the inlet opening of the attachment is arranged concentrically, while the outlet is arranged eccentrically and preferably ends near an edge of the attachment. In this manner, the drinking from the bottle when the attachment is in place is particularly easy. Moreover, in the case of an eccentrically arranged outlet, the position of the bottle during emptying is defined, because the outlet must then be arranged on the bottom end of the attachment during the emptying of the bottle with the placed attachment. Through this defined arrangement of the outlet, a ventilation opening for the reservoir can advantageously be arranged on the end of the attachment, which is at the upper side during emptying.

The channel and reservoir of the attachment are mainly separated from each other. Only one passage is provided between the reservoir and the channel, through which the second liquid transitions out of the reservoir into the channel in the case of an attachment placed on the bottle during emptying of the bottle. The passage is arranged between the inlet opening and the outlet of the channel, preferably closer to the outlet. In the case of a conventional, perpendicular alignment of the attachment, in which the outlet is arranged above the inlet opening of the channel, it is preferably arranged above the level of the second liquid in the reservoir. The passage is preferably closable in order to prevent an uncontrolled outflow of the second liquid. The closure of the passage is preferably produced as an adhesive film made of plastic, metal, impermeable paper or a composite material. An attachment with a passage closed or respectively sealed in this manner and, if applicable, a sealed ventilation opening is preferably offered for sale in a packaging, e.g. a blister packaging or a cardboard.

The passage is preferably dimensioned such that the bottle and reservoir are simultaneously emptied in equal parts during emptying so that a constant mixing ratio of the first and second liquid is achieved. The passage of the attachment with respect to the bottle opening is preferably at a scale of 1:10 to 1:200, particularly advantageously of 1:20 to 1:100.

As described above, the attachment is delimited from the surrounding area by its outer wall. The attachment is simultaneously penetrated by the channel. The reservoir is received between the channel and the outer wall. The volume of the attachment can thereby be greater than that of the reservoir required for receiving the second liquid. The reservoir is dimensioned at least large enough that the provided quantity of the second liquid can be received. The reservoir is arranged frequently annularly around the channel. This arrangement saves space, but can be disadvantageous when areas of the reservoir are arranged below the channel during the emptying of the bottle and attachment. Residues of the second liquid, which do not reach the channel through the passage during the emptying of the attachment, remain in these low-lying areas of the reservoir, because the channel is arranged above these lower-lying areas of the reservoir. In order to ensure a complete emptying of the reservoir during the emptying of the bottle, the reservoir is delimited in the attachment by a separating wall according to an advantageous embodiment of the invention. The separating wall is arranged such that it delimits the reservoir during the emptying of the container such that the entire quantity of the second liquid is dispensed through the passage as the deepest or almost deepest point of the reservoir. The separating wall is frequently arranged approximately horizontally during the emptying of the reservoir. It subdivides the interior of the attachment into the reservoir and an empty dead space.

According to an advantageous embodiment, the attachment according to the invention can also be designed such that, in the case of a bearing surface or respectively a bearing bulge arranged in the channel, the attachment in the area, which extends between the bearing surface and the inlet opening of the channel, is designed as a one-layer wall section, i.e. as a section of the outer wall, which does not include a hollow space.

BRIEF DESCRIPTION OF THE DRAWINGS

Details of the invention are described in greater detail below based on figures. They show in.

DETAILED DESCRIPTION

Figure 1:
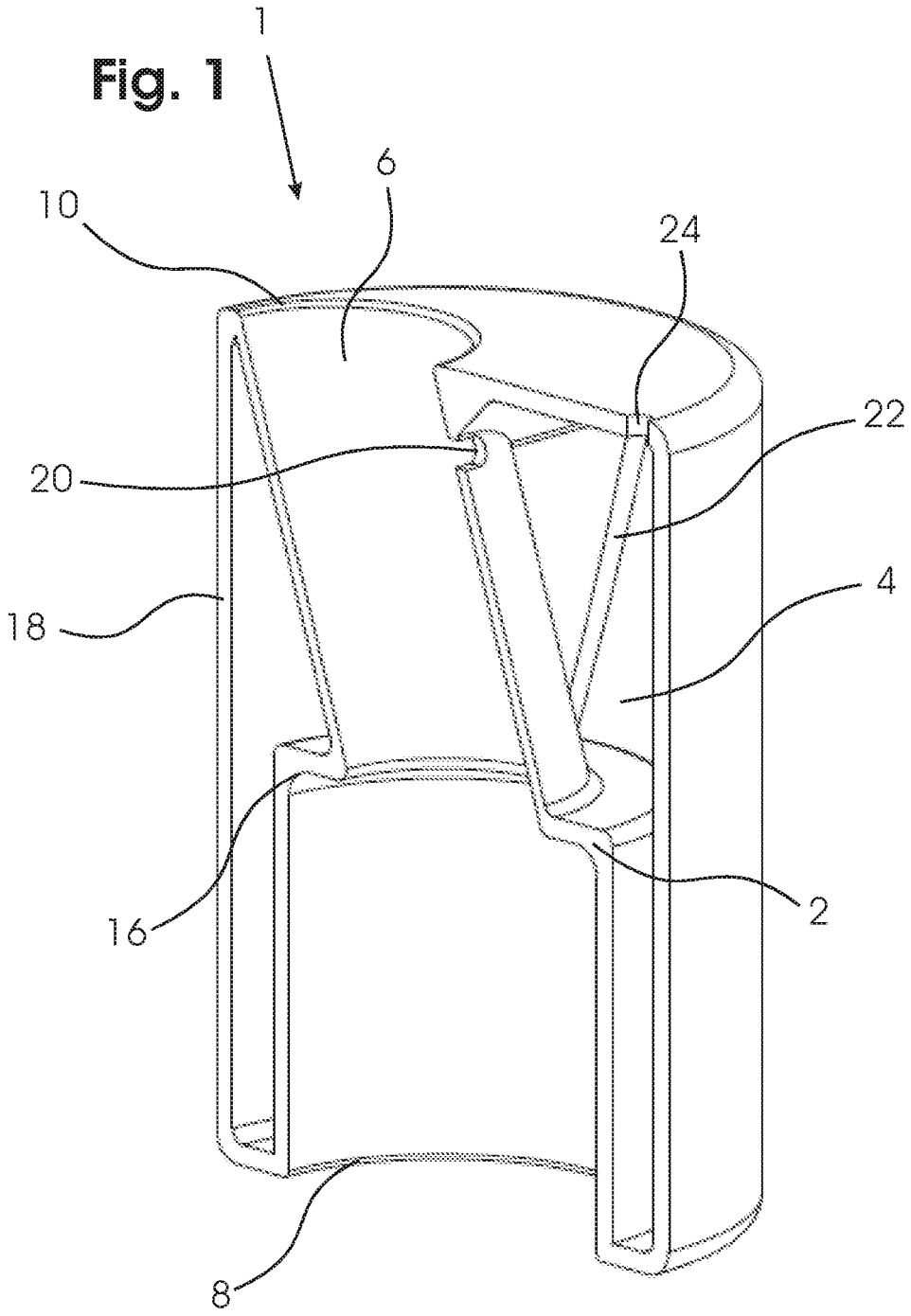
FIG. 1 a cut through the attachment according to the invention (view from the side)
Figure 2:
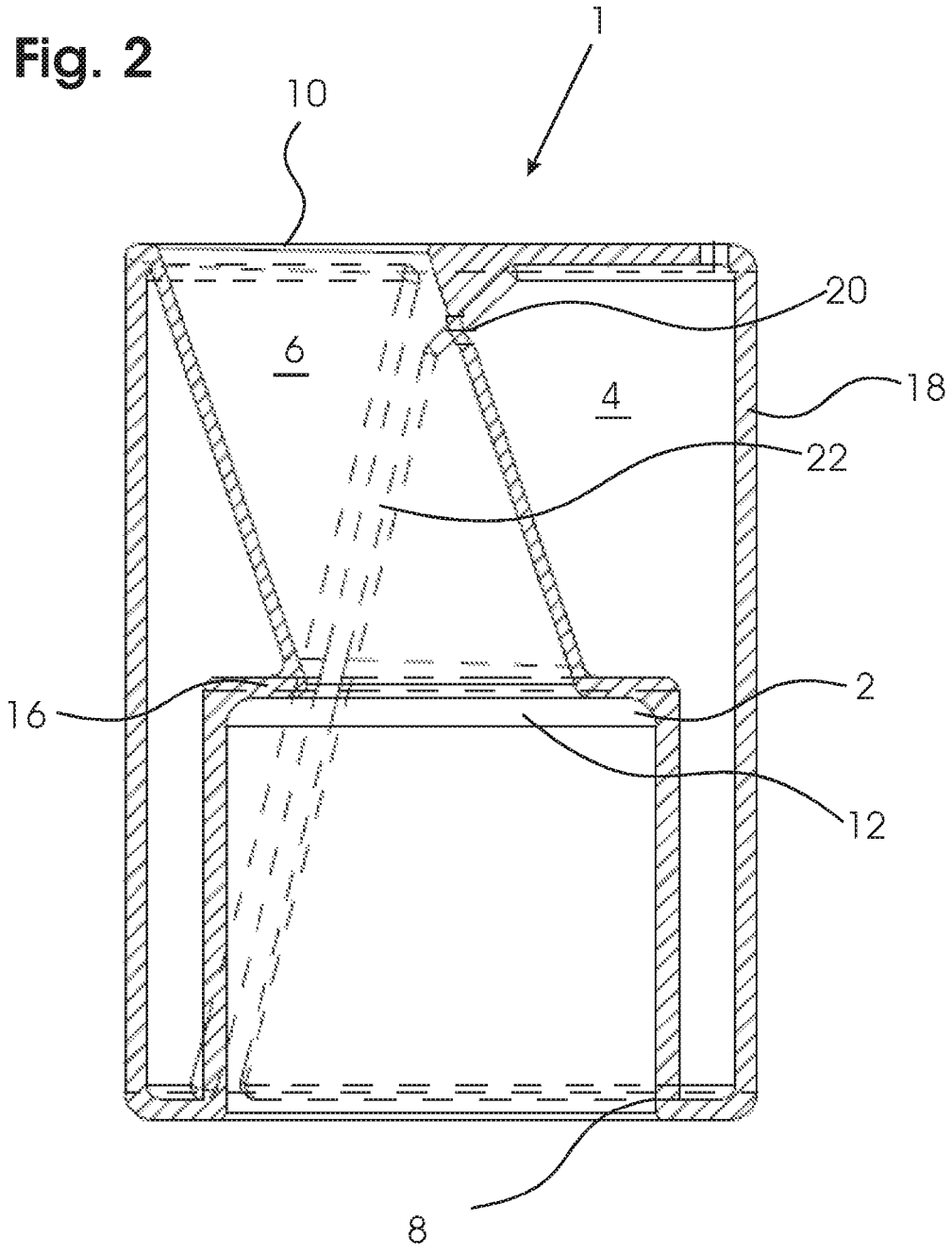
FIG. 2 a longitudinal cut through the attachment according to the invention.

FIG. 1 and FIG. 2 show an embodiment of the attachment 1 according to the invention, which is produced out of plastic in an injection-molding process. The attachment is intended to be attached to a bottle (not shown here), which contains a first liquid. The present case concerns a bottle closable with a crown cap. This first liquid is removed through a bottle opening. The bottle opening is surrounded by the bottle wall. The bottle opening is round and it is standardized for crown cap bottles. The bottle has a first section, the bottle body, which extends towards the bottle opening with the same diameter as the bottom of the bottle. The bottle has a second section, the bottle neck, which extends from the bottle opening to the bottle body. The bottle neck has a diameter, which widens from the bottle opening, which has a considerably smaller diameter than the bottom of the bottle, towards the bottle body so that the bottle neck establishes the connection from the bottle opening to the bottle body. The bottle neck has in the area of the bottle opening a bulge, with which the crown cap engages, which closes the bottle.

The attachment has a bearing surface 2, a reservoir 4 for a second liquid and a channel 6. The channel 6 establishes via an inlet opening 8 a connection between the bottle opening and an outlet 10 of the attachment after the attachment 1 has been mounted on the bottle. The bearing surface 2 is arranged in the channel 6. It is provided with a seal 12, which is made of an elastic plastic and which was glued into the channel 6 after the production of the attachment in an injection-molding process. Alternatively, the bearing surface 2 can already be integrated into the channel 6 during the production of the attachment, wherein an elastic material is to be used for producing the bearing surface, which acts in a sealing manner. However, it also is generally possible to make the attachment from an elastic plastic material that acts in a sealing manner.

Figure 4:
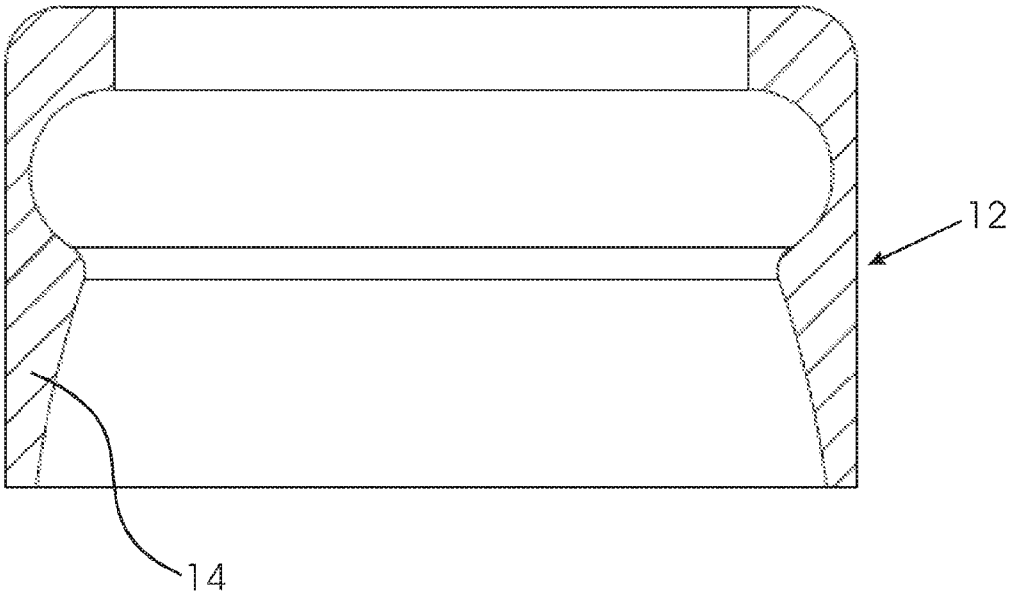
FIG. 4 a cut through a seal or respectively bearing surface.
Figure 5:
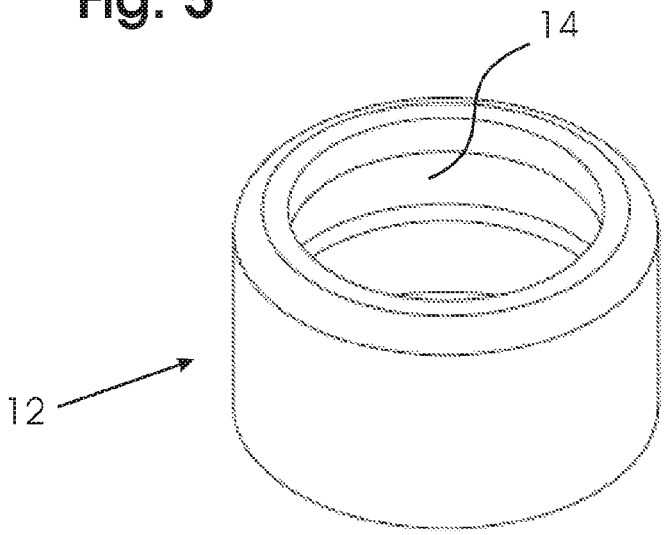
FIG. 5 a view of a seal.

The bearing surface 2 is presently designed such that the seal 12 arranged in the channel 6 has a seal profile 14, which bears in a form-fitting manner on the bulge of the bottle neck after placement of the attachment on the bottle neck or respectively surrounds the bulge of the bottle neck in a sealing manner. FIG. 4, 5 show such a seal. The seal profile 14 as a negative advantageously forms the end of the bottle neck and the bottle opening so that a bulge on the bottle neck engages around the seal 12 in a form-fitting manner. The attachment and bottle are thereby not only connected in a sealing manner.

Additionally, the mechanical stability of the connection is also improved.

Figure 3:
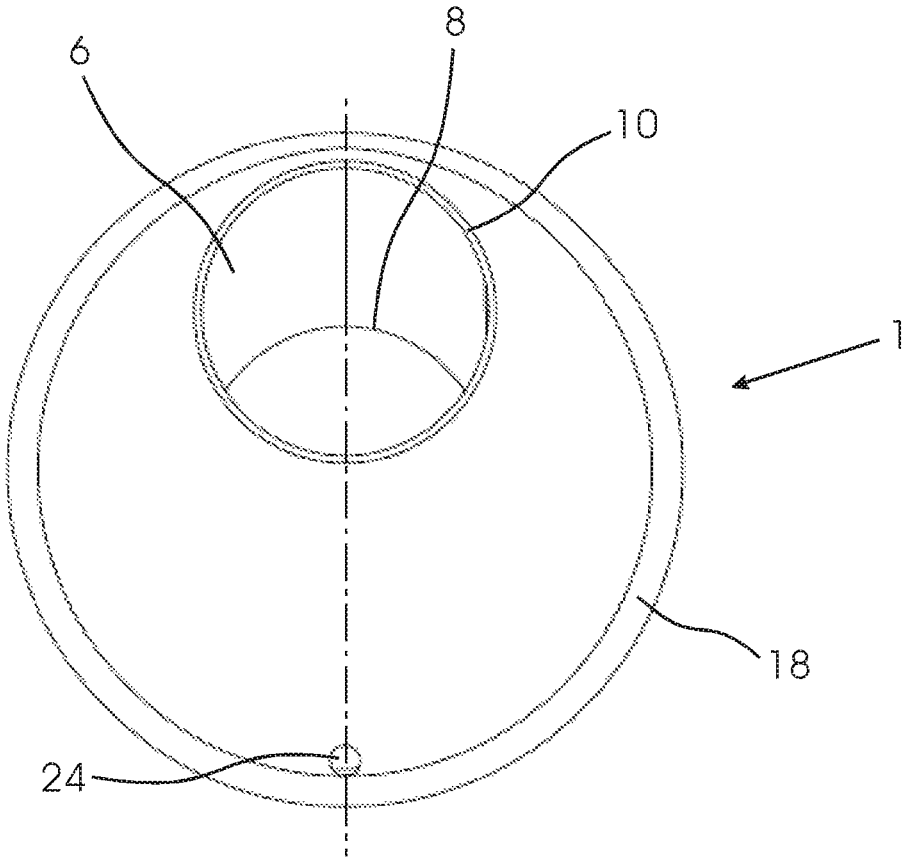
FIG. 3 a view of the attachment according to the invention from above.

According to the representation in FIG. 1, 2, the bottle neck is wider than the diameter of the bottle opening. Accordingly, the present embodiment of the attachment has a channel 6, which tapers on the bearing surface 2. This tapering is created by the molding of a shoulder 16 in the channel. The shoulder 16 can be used for the particularly simple positioning of the seal 12. From the bearing surface 2 or respectively the shoulder 16 up to the inlet opening, the diameter of the channel 6 is cylindrical and dimensioned such that the bottle neck can be received in the channel 6. The cross-section of the channel 6 tapers from the bearing surface 2 up to the outlet 10. Moreover, the progression of the channel 6 in the attachment shifts from a centric position on the bearing surface 2 to an eccentric position on the outlet 10. This shift in the progression and the tapering of the cross-section, which can be seen in FIG. 3, are optional. But they represent a preferred embodiment because an optimal position of the outlet 10 for drinking or emptying is thereby created.

As shown in FIG. 1, 2, the reservoir 4 is arranged between the outer wall 18 of the attachment and the channel 6. It is connected with the channel 6 via a passage 20. The second liquid contained in the reservoir 4 exits during emptying through the passage 20 into the channel 6. According to a simple embodiment, the reservoir 4 can take up the entire space between the outer wall 18 and the channel 6. However, the reservoir 4 preferably only takes up a part of this space. The reservoir is delimited by a separating wall 22 according to the advantageous embodiment shown in FIG. 1, 2. The separating wall 22 borders the outer wall 18 and/or the channel 6 and thereby defines the reservoir 4. The separating wall 22 is preferably designed in a manner such that the reservoir 4 is arranged in the attachment 1 so that it is emptied to the greatest degree possible or completely during the emptying of the bottle. Dead spaces should be avoided if possible in the design and arrangement of the reservoir 4, wherein dead spaces are considered as the areas in the attachment 1 that lie below the passage 20 during the emptying of the attachment.

The passage 20 has a diameter, which is determined in coordination with the channel 6 and the quantity of liquid contained in the reservoir 4. The diameter is usually between 1 mm and 5 mm. The passage 20 is preferably arranged in the channel closer to the outlet 10 than to the inlet opening 8. In this manner, a good mixture of the first and second liquid is achieved during pouring.

According to a further advantageous embodiment, the reservoir 4 has a ventilation opening 24. The ventilation opening 24 is preferably designed in the outer wall 18 of the attachment 1 according to the invention. Via the ventilation opening 24, a pressure compensation during the emptying of the reservoir 4 is ensured by the comparatively small passage 20. Alternatively, a ventilation channel can be provided, which extends with a first end on the ventilation opening in the outer wall of the attachment up to a second end, of an opening in the reservoir. The opening into the reservoir is appropriately located at a position above the liquid level in the reservoir. The ventilation channel offers with respect to a simple ventilation opening the advantage that the risk of the leakage of the liquid is minimized. Moreover, by means of the ventilation channel, the ventilation opening can be arranged near the passage 20. In this manner, according to a preferred embodiment of the invention, the passage 20 and the ventilation opening 24 can both be sealed during transport with a single closure after the filling of the reservoir with the second liquid, e.g. by a film or a composite made of plastic, metal or by a paper. The ventilation opening 24 has a diameter of preferably up to 2 mm. The closure for the passage 20 and the ventilation opening 24 is preferably adhered and is removed after the placement of the attachment 1 on the bottle. In this manner, a reliable ventilation of the reservoir 4 is ensured without which the desired removal of the second liquid from the reservoir 4 is not possible.

In a simple embodiment, the reservoir 4 can be filled through the passage 20. However, according to an advantageous embodiment of the invention, the outer wall 18 of the attachment 1 has a fill opening, which is closed by a corresponding cover. The cover can be designed in a removable manner. The cover is preferably connected, e.g. adhered or welded, in an undisconnectable manner with the attachment or respectively with the outer wall after the filling of the reservoir. A potentially present ventilation channel is preferably attached to the inside of the cover. Alternatively, the reservoir 4 can also be filled through the ventilation opening 24. A fill opening is then unnecessary.

The attachment according to the invention can be produced in any manner, particularly preferably in an injection-molding process with plastic. The attachment is preferably produced as one piece, except for the potentially used cover, which is also normally produced through injection molding and is usually only mounted after the filling of the reservoir. The cover can be made of the same material as the attachment or of a different material, e.g. of a different plastic, metal or composite material, e.g. a fiber-reinforced plastic.

After the production of the attachment 1, which has a fill opening, the reservoir 4 is filled with the second liquid, e.g. a juice or tea concentrate or an alcoholic liquid. The cover is then applied to the fill opening. Before the filling of the reservoir 4 and the application of the cover, the passage 20 and the ventilation opening 24 were sealed through gluing of an impermeable seal made e.g. of aluminum foil. The attachment 1 is thus ready to transport and use.

After the opening of a crown cap bottle, the attachment 1 is mounted on the bottle neck in that the bottle opening is inserted into the channel 6 through the inlet opening 8 of the channel 6 until the bottle opening or respectively the bottle neck engages with the seal 12. An impermeable connection is thereby created.

The bottle with the attachment 1 can now be drunk and poured from. For this purpose, the bottle with the attachment 1 is tilted and the first liquid exits through the bottle opening into the channel 6, which empties into the outlet 10. While the first liquid flows loss-free through the channel 6 in this manner and exits from the outlet 10, the second fluid flows as a result of the tilt of the attachment 1 through the passage 20 into the channel 6 and mixes with the first liquid.

The above description uses a crown cap bottle as a representative exemplary embodiment. However, it can be used for all bottles, in particular those in which the bottle neck has a bulge. Different characteristics of the attachment can be freely combined.

The invention claimed is:

1. An attachment (1) for a bottle, which holds a first liquid, wherein the bottle has a bottle opening and is surrounded by a wall, and wherein the attachment (1)

is delimited from the surrounding area by an outer wall and has a bearing surface (2) for bearing sealingly against the bottle, a reservoir (4) which is designed to hold a second liquid, a channel (6) which connects the bottle opening to an outlet (10) of the attachment (1), wherein said outlet (10) of said channel (6) is arranged eccentrically with respect to the perimeter of the attachment (1), as well as a passage (20) which connects the reservoir (4) to the channel (6), wherein the attachment (1) is designed to be attached concentrically to the bottle outside of the bottle opening, the bearing surface (2) is designed as a bearing bulge and provided with a seal (12), wherein the bearing surface (2) is arranged in the channel (6) and the reservoir (4) is outside the perimeter of the bottle opening, and wherein the reservoir (4) has a ventilation opening (24) which is positioned eccentrically to an opposite side of the circumference of the attachment (1) and laterally with respect to the position of the outlet (10), and wherein the passage (20) is positioned radially on the channel (6) facing toward the ventilation opening (24).

2. The attachment according to claim 1, wherein the reservoir (4) is arranged primarily above the bottle opening.

3. The attachment according to claim 1, wherein a separating wall is provided for delimiting the reservoir.

4. The attachment according to claim 1, wherein the channel (6) has on an inlet side of the attachment (1) an inlet opening arranged concentrically with respect to the perimeter of the attachment (1).

* * * * *